United States Patent [19]

O'Brien et al.

[11] 4,356,256

[45] Oct. 26, 1982

[54] PHOTOGRAPHIC COMPOSITIONS, ELEMENTS AND PROCESSES USING LIGHT-ACTIVATABLE ENZYMES

[75] Inventors: David F. O'Brien, Rochester; Patricia N. Tyminski, West Henrietta, both of N.Y.

[73] Assignee: Eastman Kodak Co., Rochester, N.Y.

[21] Appl. No.: 295,444

[22] Filed: Aug. 24, 1981

[51] Int. Cl.[3] ..... G03C 5/24; G03C 1/52

[52] U.S. Cl. ..... 430/332; 430/338; 430/346; 430/374; 430/401; 430/495; 430/541; 430/616

[58] Field of Search ..... 430/332, 338, 346, 374, 430/401, 495, 541, 616

[56] References Cited

U.S. PATENT DOCUMENTS 4,084,967 4/1978 O'Brien ..... 96/29 R

OTHER PUBLICATIONS

R. Yee and P. A. Liebman, "Light-Activated Phosphodiesterase of the Rod Outer Segment", J. Biol. Chem. 253, 8902, (1978).

*Primary Examiner*—Mary F. Downey
*Attorney, Agent, or Firm*—Arthur H. Rosenstein

[57] ABSTRACT

A light-sensitive composition comprising:

(1) a plurality of vesicles comprising lipid membranes containing rhodopsin;

(2) a mixture of enzymes comprising phosphodiesterase and GTPase;

(3) a first nucleotide capable of interacting with GTPase to form a cofactor necessary for the activation of phosphodiesterase;

(4) at least one metal cation selected from the group consisting of $Mg^{+2}$ and $Mn^{+2}$; and (5) a second nucleotide capable of being hydrolyzed to produce a proton, said hydrolysis reaction being catalyzed by activated phosphodiesterase, said phosphodiesterase also being activated by rhodopsin exposed by light in the presence of said cofactor and said metal cation is useful in preparing photographic elements comprising means for detecting the hydrolysis reaction, such as an indicator dye. Further, a process for forming an image in the photographic elements comprises imagewise exposing the photographic element to light having a wavelength of 350 to 600 nm, detecting said hydrolysis reaction, and optionally removing the metal cation to render the photographic element insensitive to further exposure.

46 Claims, No Drawings

PHOTOGRAPHIC COMPOSITIONS, ELEMENTS AND PROCESSES USING LIGHT-ACTIVATABLE ENZYMES

BACKGROUND OF THE INVENTION

1. Field of the Invention

This invention relates to the use of light-sensitive compositions in photographic elements and processes for forming images in the elements.

2. Description of the Prior Art

There has been recent research in the biophysical and biochemical fields concerning the molecular aspect of vision in various animals. The relationship of the light-sensitive protein rhodopsin, retinal and vitamin A has been the subject of several studies which are summarized by Wald (G. Wald, Nature 219, 800 (1968)). Rhodopsin is the primary protein component of photoreceptor cell membranes, and exists in these natural light-sensitive membranes in association with lipids, primarily phospholipids.

In order to study the biophysical aspects of this visual phenomenon, vesicle preparations of rhodopsin incorporated into phospholipid layers have been made as models to duplicate natural membranes. It has been demonstrated in these preparations that the rose-colored rhodopsin pigment is stable in the dark and rapidly fades when exposed to light to a pale yellow color. The photochemical bleaching proceeds relatively quickly, and as Wald showed, it is possible to prepare gelatin films of rhodopsin and obtain imagewise patterns (G. Wald, Science 111, 179 (1950)). However, the photochemical bleaching of rhodopsin exhibits a relatively low efficiency of about 0.7, as described by H. J. A. Dartnall in "Handbook of Sensory Physiology," Volume VII/1, ed. H. J. A. Dartnall, Springer Verlag, Berlin (1972), 122–145.

Although the role of rhodopsin in the transduction of light to electrical energy in photoreceptor cell membranes is unclear, there is general agreement that this transduction process is regulated by a transmitter molecule which is released or activated by light-exposed rhodopsin. Two mechanisms have been suggested for the transduction process.

The first suggests that calcium is the transmitter, and that it is sequestered inside rhodopsin-containing membranes in the dark and released into the cytoplasm when light bleaches the rhodopsin. It has been demonstrated that rhodopsin:egg phosphatidylcholine membrane vesicles, which are impermeable to metal ions in the dark, become permeable to metal cations such as $Ca^{+2}$, $Co^{+2}$ and $Mn^{+2}$ upon exposure to light. O'Brien, in U.S. Pat. No. 4,084,967 issued Apr. 18, 1978, discloses a photographic element comprising a binder containing numerous vesicles comprising a lipid membrane containing rhodopsin. Rhodopsin functions as a light-sensitive gate which allows diffusion of metal cations into or out of the vesicles to react with color-forming agents as a function of exposure. Although this photographic element exhibits greater efficiency than that of gelatin films containing only rhodopsin, amplification of the initial photochemical response by rhodopsin is limited by the number of metal cations or molecules of color-forming agent which can be physically contained by the vesicles of the element.

The second mechanism is an enzymatic amplification process. It has been demonstrated in recent years that absorption of light by rhodopsin leads to activation of at least two enzymes which are associated with the surface of rod outer segment membranes. These enzymes include phosphodiesterase, which catalyzes the hydrolysis of cyclic-guanosine monophosphate, and GTPase, as disclosed by W. E. Robinson and W. A. Hagins, Biophys. J., 17, 196*a* (1977) and G. L. Wheeler and M. W. Bitensky, Proc. Natl. Acad. Sci. USA 74, 4238 (1977). Further, it has been shown that the hydrolysis of cyclic-guanosine monophosphates by phosphodiesterase proceeds with great efficiency (R. Yee and P. A. Liebman, J. Biol. Chem. 253, 8902 (1978) and M. L. Woodruff and M. D. Bownds, J. Gen. Physiol. 73, 629 (1979)).

While it is known that exposure of a mixture of rhodopsin, phosphodiesterase and GTPase leads to a reduction in the amount of cyclic-guanosine monophosphate in the fluid which surrounds these natural membranes, research continues concerning the exact relationship between light-activated rhodopsin and these two enzymes.

It is seen that new classes of light-sensitive compositions using an enzymatic amplification process and exhibiting high efficiencies are desirable for use in photographic elements and processes for forming images.

SUMMARY OF THE INVENTION

It has now been found that a light-sensitive composition comprising vesicles of lipid membranes containing rhodopsin, a mixture of the enzymes phosphodiesterase and GTPase, and certain other materials is useful in photographic elements and processes for forming images. This composition and the resulting photographic element exhibit an extremely high amplification of the basic rhodopsin photochemical response which is not limited by the number of metal ions or other molecules which can be physically contained in the vesicles.

In one embodiment of the invention, a light-sensitive composition for use in photographic elements comprises a hydrophilic binder comprising:

(1) a plurality of vesicles comprising lipid membranes containing rhodopsin;

(2) a mixture of enzymes comprising phosphodiesterase and GTPase;

(3) a first triphosphate nucleotide capable of interacting with GTPase to form a cofactor necessary for the activation of phosphodiesterase;

(4) at least one metal cation selected from the group consisting of $Mg^{+2}$ and $Mn^{+2}$; and (5) a second cyclic-monophosphate nucleotide capable of being hydrolyzed to produce a proton, said hydrolysis reaction being catalyzed by activated phosphodiesterase, said phosphodiesterase also being activated by rhodopsin exposed by light in the presence of said cofactor and said metal cation, with a means for detecting protons.

In a further aspect of the invention, a photographic element comprises a support having thereon at least one layer comprising:

(1) a plurality of vesicles comprising lipid membranes containing rhodopsin;

(2) a mixture of enzymes comprising phosphodiesterase and GTPase;

(3) a first triphosphate nucleotide capable of interacting with GTPase to form a cofactor necessary for the activation of phosphodiesterase;

(4) at least one metal cation selected from the group consisting of $Mg^{+2}$ and $Mn^{+2}$;

(5) a second cyclic-monophosphate nucleotide capable of being hydrolyzed to produce a proton, said hydrolysis reaction being catalyzed by activated phosphodiesterase, said phosphodiesterase also being activated by rhodopsin exposed by light in the presence of said cofactor and said metal cation; and (6) means for detecting said hydrolysis reaction.

In a still further aspect of the invention, a process for forming an image comprises:

(a) imagewise exposing to light having a wavelength of 350 to 600 nm a photosensitive element as described above; and (b) detecting said hydrolysis reaction.

It is noted that the above-described light-sensitive compositions, photographic elements, and processes for forming images use an enzymatic amplification process and are highly advantageous in that they exhibit extremely high efficiencies ranging from about $10^3$ to more than $10^5$ protons/photon of exposing light.

DETAILED DESCRIPTION OF THE INVENTION

The light-sensitive composition used in the photographic element comprises:

(1) a plurality of vesicles comprising lipid membranes containing rhodopsin;

(2) a mixture of enzymes comprising phosphodiesterase and GTPase;

(3) a first triphosphate nucleotide capable of interacting with GTPase to form a cofactor necessary for the activation of phosphodiesterase;

(4) at least one metal cation selected from the group consisting of $Mg^{+2}$ and $Mn^{+2}$; and (5) a second cyclic-monophosphate nucleotide capable of being hydrolyzed to produce a proton, said hydrolysis reaction being catalyzed by activated phosphodiesterase, said phosphodiesterase also being activated by rhodopsin exposed by light in the presence of said cofactor and said metal cation.

It is known that the critical conversion of the second nucleotide to its hydrolyzed form, releasing a detectable proton, is catalyzed by activated phosphodiesterase. It is believed the phosphodiesterase is activated by exposed rhodopsin in the lipid vesicles and a cofactor formed by the enzyme GTPase and the first nucleotide. The cofactor-forming reaction is in turn also catalyzed by exposed rhodopsin in the lipid vesicles. The above sequence of reactions may be diagrammed as follows:

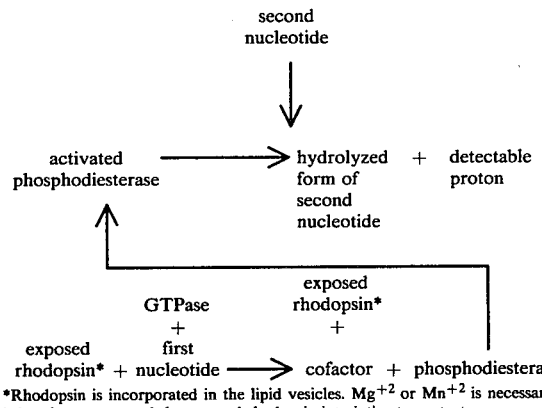

*Rhodopsin is incorporated in the lipid vesicles. $Mg^{+2}$ or $Mn^{+2}$ is necessary to bring the enzyme and the exposed rhodopsin into intimate contact.

Molecules useful in forming the lipid membrane vesicles are amphiphatic. That is, the molecules contain both a hydrophilic and hydrophobic moiety and form bilayer structures that interface with aqueous solutions. An adequate description of lipid membranes and lipids which are useful herein can be found in "Lipid Analysis" by William W. Christie, Perganon Press, Oxford, England, 1973. Further description can be found in the various biochemical articles such as G. B. Ansell, J. N. Hawthorne, and R. M. C. Dawson "Form and Function of Phospholipids," Elsevier Scientific Publishing Company, Amsterdam, The Netherlands (1973); A. D. Bangham, M. W. Hill and N. G. A. Miller, "Methods in Memrane Biology," Volume 1, ed. E. D. Korn, Plenum Press, New York (1974), page 1; and S. Razin, Biochim. Biophys. Acta 265, 241 (1972); C. Tanford "The Hydrophobic Effect," Wiley-Interscience, New York (1973).

Especially useful lipid membranes include phospholipids such as phosphatidylcholine, phosphatidylethanolamine, posphatidylserine, phosphatidylglycerol; sphingolipids, such as sphingomyelin; glycolipids, such as cerebrosides, phytoglycolipids, and gangliosides, glycerides, such as phosphonoglycerides, glycerol ethers, dialkyl phosphates; dialkyl phosphonates; alkyl phosphinate monoalkyl esters; phosphonolipids such as ceramide-2-aminoethylphosphonic acid and phosphonglycerides; sterols such as cholesterol, lanosterol, ergosterol, and β-sitosterol; alkylammonium halides, such as N,N-disubstituted dimethylammonium halides, trialkylmethylammonium halides, and tetraalkylammonium halides, dialkylsulfosuccinic acid esters; 2,3-diacyloxysuccinic acids; and polymers having both hydrophobic and hydrophilic moieties capable of forming bilayer structures that interface with aqueous solutions such as polymerized lipid diacetylenes.

In a preferred embodiment the lipid membranes comprise a phospholipid represented by the formula:

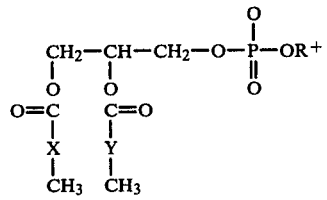

wherein X and Y are independently selected from the group consisting of saturated and unsaturated aliphatic groups containing 10 carbon atoms or greater and preferably from 14 to 22 carbon atoms such as alkylene such as decylene, dodecylene, tetradecylene, hexadecylene and octadecylene, and $R^+$ is selected from the group consisting of 2-trimethylammonioethyl ($-CH_2CH_2N^+(CH_3)_3$); ammonioethyl ($-CH_2CH_2N^+H_3$); and 2-carboxy-2-ammonioethyl

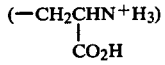

Further examples of phospholipids can be found in "Methods in Membrane Biology" by Korn, Volume 1, Plenum Press, New York, 1974, pages 55–60.

It is believed that the rhodopsin which is incorporated in the vesicles functions as a light-sensitive activator for the phosphodiesterase and GTPase enzymes. The rhodopsin is a protein pigment generally found in the retina of the eye and is obtained from animals such as cattle, sheep, horses, amphibians, birds and fish. The rhodopsin is generally obtained by detergent extraction of photoreceptor cell membranes.

Various methods of obtaining rhodopsin are found in the following articles: G. Wald, Nature 219, 800 (1968); F. J. M. Daeman, Biochim. Biophys. Acta 300, 255 (1973); K. Hong and W. L. Hubbell, Biochemistry 12, 4517 (1973); and M. L. Applebury, D. M. Zuckerman, A. A. Lamola, and T. M. Jovin, Biochemistry 13, 3448 (1974).

The molar ratio of rhodopsin to lipid in the vesicles varies widely but is generally from about 1:25 to about 1:25,000. The preferred molar ratio of rhodopsin to lipids is 1:50 to 1:1000.

As used herein, the term "vesicles" refers to spherical closed assemblages of lipid membranes having a single bilayer comprising a hydrophobic portion and a hydrophilic portion, and which enclose an aqueous volume.

The vesicles containing rhodopsin and lipids are generally formed by adding isolated rhodopsin in an aqueous buffer solution containing a detergent such as N-tridecyl-N,N,N-trimethylammonium bromide, N-dodecyl-N,N,N-trimethylammonium Br, octyl-$\beta$-D-glucoside or dodecyldimethylamine oxide to the lipid. The resulting solution is equilibrated and the detergent is removed by dialysis. The removal of detergent causes the lipids to self assemble into a bilayer membrane with the incorporated rhodopsin. More extensive discussions of the vesicle formation is found in K. Hong and W. L. Hubbell, Proc. Nat. Acad. Sci., U.S., 69, 2617 (1972) and K. Hong and W. L. Hubbell, Biochemistry 12, 4517 (1973).

The size of the vesicles formed varies, but is generally between about 250 Å to 10 microns, as estimated by negative stain (ammonium molybdate) electron microscopy. A preferred range is from 300 Å to 5000 Å. The vesicles of the invention generally have a wall thickness of about 50 Å.

The light-sensitive composition further comprises a mixture of enzymes comprising phosphodiesterase and GTPase. Thse enzymes are associated with the surface of rod outer segment membranes of the retinae, such as vertabrate retinae, of various animals. It is believed that GTPase forms a cofactor necessary to activate phosphodiesterase, and that phosphodiesterase, when activated by light-exposed rhodopsin in the presence of GTPase, at least one metal cation selected from the group consisting of $Mn^{+2}$ and $Mg^{+2}$ and the nucleotides described below, catalyzes the hydrolysis reaction of the invention. The concentration of phosphodiesterase is varied between about 0.1 $\mu$M and 1 mM, and the concentration of GTPase is varied between about 0.1 $\mu$M and 1 mM.

In a preferred embodiment, the enzymes phosphodiesterase and GTPase are isolated by washing rod outer segment membranes obtained from dark-adapted vertebrate retinae with a hypotonic buffer solution. Preferably, this solution of enzymes is concentrated by ultrafiltration, evaporation, ultracentrifugation or other techniques known in the art to restore the concentration of the enzymes to the desired level.

The metal cation of the invention is selected from the group consisting of $Mn^{+2}$ and $Mg^{+2}$. The concentration of the metal cation varies widely from about 0.5 mM to about 10 mM, but it is generally in the range from about 1 to about 5 mM.

The light-sensitive composition of the invention further comprises the first and second nucleotides described below. As used herein, the term "nucleotide" refers to sugar-phosphate esters of nucleosides, which are N-glycosyl derivatives of heterocyclic bases. Nucleotides are obtained by mild chemical or enzymatic hydrolysis of nucleic acids, as described in Organic Chemistry of Nucleic Acids, Edited by N. K. Kochelkov and E. I. Budovskii, Plenum Press, London and N.Y. (1971). Preferred nucleotides are derived from adenine or guanine cyclic bases by preparing the N-glycosyl derivatives (nucleosides) and then esterifying with a phosphate ester.

The first nucleotide of the invention comprises any triphosphate nucleotide capable of interacting with GTPase to form a cofactor necessary for the activation of phosphodiesterase. Useful nucleotides include guanosine triphosphate (GTP), adenosine triphosphate, inosine triphosphate, xanthosine triphosphate, $\alpha,\beta$-methylene GTP, $\beta,\gamma$-methylene GTP and $\beta,\gamma$-imido GTP. The preferred first nucleotide is guanosine triphosphate.

The concentration of the first nucleotide varies widely, but is generally between about 1 $\mu$M and about 10 mM, depending upon the particular nucleotide.

The second nucleotide of the invention comprises any cyclic-monophosphate nucleotide capable of being hydrolyzed to produce a proton, said hydrolysis reaction being catalyzed by phosphodiesterase activated by rhodopsin exposed to light in the presence of the cofactor formed as above and said metal cation. Useful second nucleotides include cyclic-guanosine monophosphate (GMP), cyclic-adenosine monophosphate and substituted cyclic-GMP. The preferred second nucleotide is cyclic-guanosine monophosphate.

The concentration of the second nucleotide varies widely, but is generally between about 50 $\mu$M and 5 mM. When the second nucleotide is cyclic-guanosine monophosphate, the hydrolysis reaction of the invention can be written as follows:

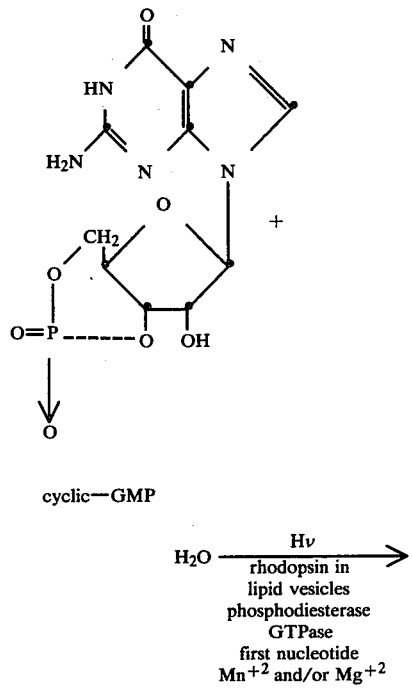

-continued

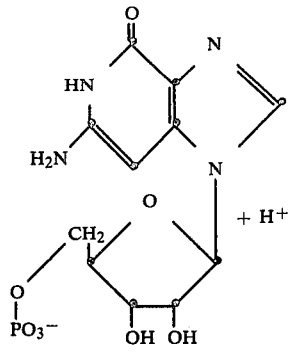

GMP

By this phosphodiesterase-catalyzed reaction, the hydrolyzed form of the second nucleotide and a proton are produced with great efficiency. Efficiencies of $10^5$ protons/photon of exposing light are often achieved when the second nucleotide is the preferred cyclic-guanosine monophosphate.

In one embodiment, the light-sensitive composition comprises a hydrophilic binder. A wide variety of hydrophilic binders are useful, and the binder need not be polymeric. Preferred hydrophilic binders include gelatin, poly(vinyl alcohol), poly(N-vinyl-2-pyrrolidone), polyacrylamide and copolymers derived from acrylamide, and acrylic homo- and copolymers derived from hydrophilic monomers such as acrylic acid, methacrylic acid, vinylbenzyl alcohol, hydroxyalkyl acrylates, N-hydroxyalkylacrylamides, and sulfoalkyl acrylates. A most preferred hydrophilic binder comprises gelatin.

The concentration of the hydrophilic binder varies depending upon, for example, the particular lipid membrane employed and the resolution desired of the resulting image. Preferably, however, the light-sensitive composition comprises from about 2 to about 15 percent by weight of the hydrophilic binder.

In another embodiment, the light-sensitive composition comprises means for detecting the hydrolysis reaction catalyzed by phosphodiesterase. Useful detecting means include means such as indicator dyes, pH electrodes and acid catalyzed reactions. The preferred detecting means is an indicator dye which exhibits a visible color change between pH 7 and pH 9, the pH range over which the above-described hydrolysis reaction most readily occurs. Useful indicator dyes include cresol purple, bromothymol blue, neutral red, phenol red, cresol red and α-naphtholphthalein. Most preferably the indicator dye is cresol purple.

The light-sensitive composition optionally comprises addenda such as coating aids, stabilizers, buffering agents and chelating agents.

The light-sensitive compositions are prepared by either of two processes. One process comprises the steps of combining isolated rhodopsin with a lipid to form vesicles comprising lipid membranes containing rhodopsin, and combining the vesicles with the enzymes phosphodiesterase and GTPase, at least one metal cation selected from the group consisting of $Mn^{+2}$ and $Mg^{+2}$, and the above-described first and second nucleotides.

Preferably this process comprises:

(a) forming a dispersion of vesicles comprising lipid membranes containing rhodopsin by:

(i) isolating rhodopsin from rod outer segment membranes obtained from dark-adapted vertebrate retinae;

(ii) combining the isolated rhodopsin with a lipid and a detergent to form a solution; and (iii) removing the detergent from the solution to form a dispersion of vesicles;.

(b) isolating the mixture of enzymes by washing rod outer segment membranes obtained from dark-adapted vertebrate retinae with a hypotonic buffer solution to form a solution of the mixture of enzymes; and (c) combining the solution of enzymes with the dispersion of vesicles of step (a) and predetermined amounts of the metal cation and the first and second nucleotides described above.

Rod outer segment membranes are generally obtained from frozen, dark-adapted vertebrate retinae, such as cattle, sheep, amphibions, birds and fish retinae by sucrose flotation techniques as described in K. Hong and W. L. Hubbell, Biochemistry, 12, 4517 (1973) and other membrane isolation techniques known in the art. Rhodopsin, generally isolated from the rod outer segment membranes by detergent extraction is preferably purified by column chromatography. The isolated rhodopsin is combined with any of the above-described lipids in a molar ratio 1:25 to 1:25,000 and a detergent such as N-tridecyl-N,N,N-trimethylammonium bromide in an aqueous buffer to form a solution. The detergent solution is equilibrated for a period of from about 1 to about 15 hours and the detergent is removed, for example, by dialysis against an aqueous buffer solution having a pH from 5 to 9 for a period of from 1 to 5 days, periodically changing the dialysis medium, preferably every 10 to 14 hours. Other methods of removing the detergent include gel permeation chromatography, density gradient ultracentrifugation and injection dilution techniques. The removal of the detergent causes the lipids to self-assemble into vesicles having a bilayer lipid membrane containing rhodopsin. The resulting dispersion of vesicles is preferably concentrated to a 1 to 5 weight/volume ratio, most preferably to a 2 to 3 percent weight/volume ratio, by techniques such as ultrafiltration and ultracentrifugation.

The enzymes phosphodiesterase and GTPase are generally isolated from dark-adapted, vertebrate rod outer segment membranes which have been prewashed with an aqueous buffer solution to remove undesired soluble proteins. The desired enzymes are then extracted by washing the membranes with a hypotonic buffer solution to form a solution of enzymes. Preferably, this solution of enzymes is then concentrated by ultrafiltration or ultracentrifugation to the original protein content or to an enzyme concentration in the desired range of from 10 μg protein/ml to 5 mg protein/ml.

A preferred method for adding a predetermined amount of the desired metal cation is to employ a cytoplasmic buffer solution in which the metal cation is present in the desired concentration as the aqueous buffer solution in which the final light-sensitive dispersion is suspended. The pH of the cytoplasmic buffer solution ranges from 5 to 9, but generally is about 8.0. Sufficient amounts of the first and second nucleotides are generally added to the final dispersion to increase their concentration to the desired level.

An alternate process for preparing the light-sensitive composition of the invention is selected from the group consisting of:

(a) isolating vesicles comprising the lipid membranes containing rhodopsin and the mixture of enzymes, and combining the vesicles with the above-described metal cation and first and second nucleotides; and (b) isolating vesicles comprising lipid membranes containing rhodopsin, but from which membranes the mixture of enzymes has been removed, and combining the vesicles with the mixture of enzymes, the metal cation and the first and second nucleotides previously described.

Vesicles comprising lipid membranes containing rhodopsin and the mixture of enzymes are preferably obtained by isolating rod outer segment membranes from dark-adapted vertebrate retinae by the same methods described above. However, these naturally occurring vesicles generally comprise only lipids selected from the group consisting of phospholipids and sterols.

All of the above processes are carried out in dim red light or in complete darkness with the aid of an infrared image converter in order to preserve the light-sensitivity of the resulting composition.

If the light-sensitive composition is to comprise a hydrophilic binder, the hydrophilic binder is generally added to the composition after any of the above-described processes. Preferably a 5 to 35 percent (weight/volume), more preferably 15 to 25 percent, solution of the hydrophilic binder in aqueous buffer solution containing the desired concentration of metal cation is mixed with the light-sensitive composition after the completion of any of the above processes. The volume:volume ratio of binder solution to light-sensitive composition ranges from about 0.1:1 to about 10:1, but preferably varies from about 0.5:1 to about 1.0:1.

If the light-sensitive composition comprises means for detecting the hydrolysis reaction, the detecting means is generally added to the composition after the completion of any of the above-described processes. In a preferred embodiment, an indicator dye such as cresol purple is added as a solution in aqueous buffer containing the metal cation at the desired concentration. If an indicator dye is selected as the detecting means, the concentration of the dye depends upon the coating thickness, the concentration of second nucleotide and extinction coefficient of the dye and generally varies between about 10 $\mu$M and about 10 mM.

The light-sensitive compositions described herein are useful in photographic elements. The photographic elements of the invention are prepared by coating the described light-sensitive composition comprising means for detecting the described hydrolysis reaction on a support. Useful coating methods include dip coating, roll coating, curtain coating, spin coating and hand doctor blade coating. Preferably the light-sensitive composition is coated onto a support at a coating coverage in the range from about $10^{-3}$ to about $10^{3}$ grams of composition per square meter of support, which corresponds to about $10^{15}$ to about $10^{19}$ vesicles per square meter.

Materials useful as supports for photographic elements include cellulosic products such as paper, polymers such as polyesters such as poly(ethylene terephthalate), cellulose acetate, cellulose acetate butyrate, cellulose nitrate, polycarbonates and polystyrene; metals such as aluminum, copper, zinc and tin; and siliceous materials such as glass.

In one embodiment, all of the materials forming the light-sensitive composition and the means for detecting the hydrolysis reaction are coated in a single layer in the photographic element. However, it is noted that in other embodiments in which the photographic element comprises more than one layer, at least one member of the group consisting of vesicles comprising lipid membranes containing rhodopsin, the enzyme phosphodiesterase, the enzyme GTPase, the first nucleotide, the metal cation, the second nucleotide, and means for detecting the hydrolysis reaction, is present in one layer and the remainder of the above group is present in one or more other layers of the multilayer photographic element.

The preferred process for forming an image comprises:

(a) imagewise exposing the photographic element to light having a wavelength of 350 to 600 nm, generally having a peak of about 500 nm; and (b) detecting the resulting hydrolysis reaction.

In an especially preferred embodiment, the process for forming an image comprises subsequently removing the metal cation to render the photographic element insensitive to further exposure. Methods for reducing the activity of the metal cation in the photographic element include metal cation complexation.

The following preparations and examples are included to illustrate the practice of this invention.

PREPARATION 1

Rhodopsin

The following procedure was carried out in dim red light. Frozen, dark-adapted bovine retinae were obtained, and rod outer segment membranes were isolated by sucrose flotation techniques. Rhodopsin was isolated from the rod outer segment membranes by detergent extraction and purification to remove the remaining outer membrane components by column chromatography on hydroxylapatite.

PREPARATION 2

Phosphodiesterase and GTPase

Frozen, dark-adapted bovine retinae were obtained, and rod outer segment membranes were isolated in a cytoplasmic buffer at pH 8.0 having the following composition:

60 mM KCl
30 mM NaCl
2 mM $MgCl_2$
1 mM dithiothreitol
3 mM glucose
10 mM tri(hydroxymethyl)aminomethane.

The membranes were washed in this buffer to remove soluble proteins, and then washed in a hypotonic buffer at pH 8.0 having the composition:

0.1 mM [ethylenebis(oxyethyleneitrilo)]tetraacetic acid
1 mM dithiothreitol
10 mM tri(hydroxymethyl)aminomethane to extract the enzymes phosphodiesterase and GTPase from the membranes. The enzyme extracts were concentrated by ultrafiltration to a concentration of 100 $\mu$g protein/ml (original protein content).

EXAMPLE 1

Light-sensitive Composition Comprising Phosphatidylcholine

The purified rhodopsin of Preparation 1 was combined with an aqueous buffer solution of 100 mM N-tridecyl-N,N,N-trimethylammonium bromide and purified phosphatidylcholine derived from egg yolk in a molar ratio of 1 part rhodopsin to 500 parts phosphatidylcholine. The detergent solution was equilibrated for a few hours, and the detergent was removed by dialysis against an aqueous buffer solution consisting 10 mM N-2-hydroxyethylpiperazine-N'-2-ethanesulfonic acid and 1 mM ethylenediamine tetracetic acid at pH 7.0, which had been flushed with argon. The dialysis medium was changed every 10 to 14 hours for 2 to 3 days. The removal of the detergent by dialysis caused by phospholipids to self-assemble into a bilayer lipid membrane with the rhodopsin incorporated into the membrane. The resulting dispersion of vesicles was collected and concentrated to a 2 to 3 percent weight-/volume ratio by ultrafiltration with a Diaflo® filter made by Amicon® Corporation.

The rhodopsin:egg phosphatidylcholine vesicles and the concentrated extract of phosphodiesterase and GTPase of Preparation 2 were combined in the dark at room temperature in a cytoplasmic buffer solution of the following composition:

60 mM KCl
30 mM NaCl
2 mM $MgCl_2$
1 mM dithiothreitol
3 mM glucose
10 mM tri(hydroxymethyl)aminomethane.

Sufficient amounts of guanosine triphosphate and cyclic-guanosine monophosphate were added to produce concentrations of 0.25 mM and 1 mM, respectively.

The light-sensitive composition was exposed with a 1 millisecond duration strobe light through a Corning® 5-57 filter (340–540 nm), and the pH response before and after exposure was followed with a Corning® combination pH electrode. Immediately upon light exposure, the pH began to decrease. The light bleached about 2 percent of the rhodopsin, and a decrease of 0.17 pH unit, corresponding to an efficiency of about $8\times10^3$ protons produced per photon absorbed, was observed. When the experiment was repeated at lower bleach levels ranging from 0.1 to 0.01 percent, efficiencies of greater than $10^5$ protons/photon were observed.

EXAMPLE 2

Light-sensitive Compositions Comprising a Mixture of Phospholipids

A dispersion of vesicles was prepared from the purified rhodopsin of Preparation 1 and phospholipids comprising egg phosphatidylcholine, egg phosphatidylethanolamine, and bovine brain phosphatidylserine by the procedure of Example 1 in a molar ratio of 225 to 225 to 50, respectively, to 1 part of rhodopsin. The enzyme solution of Preparation 2 was combined with the dispersion of vesicles as in Example 1, and sufficient amounts of guanosine triphosphate and cyclic-guanosine monophosphate were added to produce concentrations of 0.25 mM and 1 mM, respectively.

The light-sensitive composition was exposed in dim red light from a Kodak Safelight filter #2 and monitored with a pH electrode as in Example 1. Immediately upon light exposure, the pH of the composition began to decrease. At a bleach level of 1 percent, the total pH decrease of 0.17 pH unit was observed, corresponding to an efficiency greater than $10^4$ protons produced per photon absorbed.

EXAMPLE 3

Light-sensitive Composition Prepared by an Alternate Process and Comprising an Indicator Dye Frozen, dark-adapted bovine retinae were obtained, and rod outer segment membranes were isolated by sucrose flotation techniques in dim red light in a cytoplasmic buffer solution. These membranes contained vesicles comprising natural phospholipid membranes containing 5 nM rhodopsin and the enzymes phosphodiesterase (0.25 nM) and GTPase (0.5 nM). An aliquot of the dispersion of membranes was combined with sufficient guanosine triphosphate and cyclic-guanosine monophosphate to produce concentrations of these nucleotides of 0.25 and 2 mM, respectively. An aliquot of $5\times10^{-5}$ cresol purple indicator dye solution in a buffer at pH 8.0 was added. The buffer employed contained:

60 mM KCl
30 mM NaCl
2 mM $MgCl_2$
3 mM glucose
1 mM dithiothreitol
0.1 mM [ethylenebis(oxyethylenenitrilo]tetraacetic acid
2.5 mM tri(hydroxymethyl)aminomethane.

The resulting dispersion was purple-brown in color due to the presence of the indicator dye at pH 8.1.

When flash-exposed as described in Example 1, the dispersion began to change color, and in 100 to 200 seconds, became yellow. The pH decreased about 0.8 pH unit depending upon the intensity of the flash exposure, corresponding to efficiencies from $2\times10^4$ to $3\times10^5$ protons produced per photon absorbed.

Rod outer segment membranes isolated as above, but which had been washed with the hypotonic buffer solution of Preparation 2 in order to remove the phosphodiesterase and GTPase enzymes, did not produce a pH change upon exposure to light when combined with the nucleotides and $Mg^{+2}$ metal cation as described above.

EXAMPLE 4

Light-sensitive Composition Prepared by an Alternate Process

Rod outer segment membranes were isolated and washed with a hypotonic buffer solution as in Example 3. An aliquot of these washed membranes, containing vesicles comprising natural phospholipid membranes containing rhodopsin, was combined with the concentrated enzyme solution of Preparation 2, and appropriate amounts of guanosine triphosphate and cyclic-guanosine monophosphate in a cytoplasmic buffer solution as described in Example 1. The sample was flash-exposed and the pH recorded before and after exposure as in Example 1. A decrease of 0.12 pH unit was observed after exposure.

EXAMPLE 5

Light-sensitive Composition Comprising 1:100 Rhodopsin:Phosphatidylcholine

A dispersion of vesicles was prepared from purified rhodopsin and egg phosphatidylcholine as in Example 1, except that the molar ratio of rhodopsin to phosphatidylcholine was 1:100. The dispersion of vesicles was combined with a solution of enzymes and nucleotides in a cytoplasmic buffer solution, flash-exposed, and the pH monitored as described in Example 1. Light exposure of the sample dispersion produced a decrease in the pH of the sample in the same manner as the previous examples.

EXAMPLE 6

Photographic Element

Rod outer segment membranes were isolated in the cytoplasmic buffer solution of Preparation 2 by sucrose flotation techniques, as in Example 3. A coating melt was prepared as follows:

- 1.0 mL rod outer segment membranes (200 μM in rhodopsin)
- 1.8 mL 20 percent weight/volume deionized gelatin
- 0.2 mL 10 mM cresol purple indicator dye
- 0.5 mL 10 mM guanosine triphosphate
- 0.5 mL 160 mM cyclic-guanosine monophosphate
- 0.4 mL 0.1 M NaOH, where each solution was in an aqueous buffer at pH 8.0 having the following composition:

- 60 mM KCl
- 30 mM NaCl
- 2 mM $MgCl_2$
- 3 mM glucose
- 1 mM dithiothreitol
- 0.1 mM [ethylenebis(oxyethylenenitrilo)]tetraacetic acid
- 2.5 mM tri(hydroxymethyl)aminomethane.

The mixture was warmed to 100° F. (38° C.) in the dark and coated on subbed poly(ethylene terephthalate) support at a spreading thickness of 10 ml. The coating was chill set for 1 minute, and air dried.

Imagewise exposure of a portion of the coating to a blue light flash resulted in an imagewise bleaching pattern. The original exposed areas were a light yellow color and the unexposed areas were a purple-brown color. The image areas were yellow due to the photocatalyzed production of protons, which lowered the pH in exposed areas of the coating and reacted with the indicator dye.

Similar results were observed with a freshly prepared, still damp coating, and a dry-to-the-touch coating which had been air dried at room temperature overnight.

The invention has been described in detail with particular reference to preferred embodiments thereof, but it will be understood that variations and modifications can be effected within the spirit and scope of the invention.

What is claimed is:

1. A photographic element comprising a support having thereon at least one layer comprising:

(1) a plurality of vesicles comprising lipid membranes containing rhodopsin;

(2) a mixture of enzymes comprising phosphodiesterase and GTPase;

(3) a first triphosphate nucleotide capable of interacting with GTPase to form a cofactor necessary for the activation of phosphodiesterase;

(4) at least one metal cation selected from the group consisting of $Mg^{+2}$ and $Mn^{+2}$; and (5) a second cyclic-monophosphate nucleotide capable of being hydrolyzed to produce a proton, said hydrolysis reaction being catalyzed by activated phosphodiesterase, said phosphodiesterase also being activated by rhodopsin exposed by light in the presence of said cofactor and said metal cation; said element comprising a means for detecting said hydrolysis reaction.

2. The photographic element of claim 1 wherein said lipid membranes are selected from the group consisting of phospholipids, sphingolipids, glycolipids, glycerides, glycerol ethers, dialkyl phosphates, dialkyl phosphonates, alkylphosphinate monoalkyl esters, phosphonolipids, sterols, alkylammonium halides, dialkylsulfosuccinic acid esters, 2,3-diacyloxysuccinic acids, and polymers having both hydrophobic and hydrophilic moieties capable of forming bilayer structures that interface with aqueous solutions.

3. The photographic element of claim 2 wherein said lipid membranes comprise a phospholipid represented by the formula:

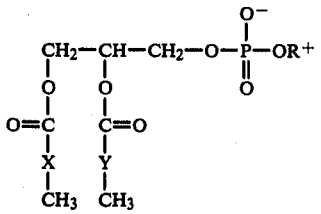

wherein X and Y are independently selected from the group consisting of saturated and unsaturated aliphatic groups, and $R^+$ is 2-trimethylammonioethyl, ammonioethyl or 2-carboxy-2-ammonioethyl.

4. The photographic element of claim 1 wherein the molar ratio of rhodopsin to lipid in said vesicles is from 1:25 to 1:25,000.

5. The photographic element of claim 1 wherein said first nucleotide comprises guanosine triphosphate.

6. The photographic element of claim 1 wherein said second nucleotide comprises cyclic-guanosine monophosphate.

7. The photographic element of claim 1 wherein the vesicle size is from about 250 Å to about 10 microns.

8. The photographic element of claim 1 wherein said layer comprises a hydrophilic binder.

9. The photographic element of claim 8 wherein said hydrophilic binder is gelatin.

10. The photographic element of claim 1 wherein said detecting means is an indicator dye.

11. The photographic element of claim 1 wherein the photographic element comprises more than one layer, and wherein at least one member of the group consisting of said vesicles, said enzyme phosphodiesterase, said enzyme GTPase, said first nucleotide, said metal cation, said second nucleotide and said detecting means, is present in one layer and the remainder of said group is present in one or more other layers.

12. A photographic element comprising a support having thereon a layer comprising a hydrophilic binder containing:

(1) a plurality of vesicles comprising phospholipid membranes containing rhodopsin;

(2) a mixture of enzymes comprising phosphodiesterase and GTPase;

(3) at least one metal cation selected from the group consisting of $Mg^{+2}$ and $Mn^{+2}$; and (4) a mixture of nucleotides comprising cyclic-guanosine monophosphate and guanosine triphosphate; said element comprising a means for detecting protons.

13. The photographic element of claim 12 wherein said phospholipid membranes comprise a phospholipid represented by the formula:

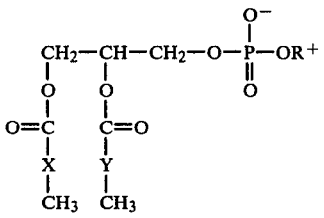

wherein X and Y are independently selected from the group consisting of saturated and unsaturated aliphatic groups, and $R^+$ is 2-trimethylammonioethyl, ammonioethyl or 2-carboxy-2-ammonioethyl.

14. The photographic element of claim 12 wherein the molar ratio of rhodopsin to lipid in said vesicles is from 1:25 to 1:25,000.

15. The photograhic element of claim 12 wherein the vesicle size is from about 250 Å to about 10 microns.

16. The photographic element of claim 12 wherein the hydrophilic binder is gelatin.

17. The photographic element of claim 12 wherein said means for detecting protons is an indicator dye.

18. The photographic element of claim 12 wherein the photographic element comprises more than one layer, and wherein at least one member of the group consisting of said vesicles, said enzyme phosphodiesterase, said enzyme GTPase, said metal cation, said cyclic-guanosine monophosphate, said guanosine triphosphate and said detecting means is present in one layer and the remainder of said group is present in one or more other layers.

19. A process for forming an image comprising:

(a) imagewise exposing to light having a wavelength of 350 to 600 nm a photosensitive element comprising a support having thereon at least one layer comprising:

(1) a plurality of vesicles comprising lipid membranes containing rhodopsin;

(2) a mixture of enzymes comprising phosphodiesterase and GTPase;

(3) a first triphosphate nucleotide capable of interacting with GTPase to form a cofactor necessary for the activation of phosphodiesterase;

(4) at least one metal cation selected from the group consisting of $Mg^{+2}$ and $Mn^{+2}$; and (5) a second cyclic-monophosphate nucleotide capable of being hydrolyzed to produce a proton, said hydrolysis reaction being catalyzed by activated phosphodiesterase, said phosphodiesterase also being activated by rhodopsin exposed by light in the presence of said cofactor and said metal cation;

(b) detecting said hydrolysis reaction.

20. The process of claim 19 wherein said lipid membranes are selected from the group consisting of phospholipids, sphingolipids, glycolipids, glycerides, glycerol ethers, dialkyl phosphates, dialkyl phosphonates, alkylphosphinate monoalkyl esters, phosphonolipids, sterols, alkylammonium halides, dialkylsulfosuccinic acid esters, 2,3-diacyloxysuccinic acids, and polymers having both hydrophobic and hydrophilic moieties capable of forming bilayer structures that interface with aqueous solutions.

21. The process of claim 19 wherein said lipid membranes comprise a phospholipid represented by the formula:

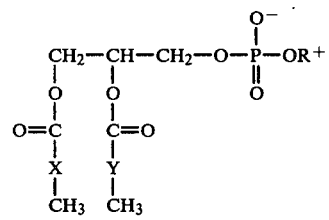

wherein X and Y are independently selected from the group consisting of saturated and unsaturated aliphatic groups, and $R^+$ is 2-trimethylammonioethyl, ammonioethyl or 2-carboxy-2-ammonioethyl.

22. The process of claim 19 wherein the molar ratio of rhodopsin to lipid in said vesicles is from 1:25 to 1:25,000.

23. The process of claim 19 wherein said first nucleotide comprises guanosine triphosphate.

24. The process of claim 19 wherein said second nucleotide comprises cyclic-guanosine monophosphate.

25. The process of claim 19 wherein the vesible size is from about 250 Å to about 10 microns.

26. The process of claim 19 wherein said layer comprises a hydrophilic binder.

27. The process of claim 26 wherein said hydrophilic binder is gelatin.

28. The process of claim 19 wherein said detecting means comprises an indicator dye.

29. The process of claim 19 wherein the photographic element comprises more than one layer, and wherein at least one member of the group consisting of said vesicles, said enzyme phosphodiesterase, said enzyme GTPase, said first nucleotide, said metal cation, said second nucleotide and said detecting means, is present in one layer and the remainder of said group is present in one or more other layers.

30. The process of claim 19 comprising removing said metal cation to render said photographic element insensitive to further exposure.

31. A light-sensitive composition comprising a hydrophilic binder containing:

(1) a plurality of vesicles comprising phospholipid membranes containing rhodopsin;

(2) a mixture of enzymes comprising phosphodiesterase and GTPase;

(3) at least one metal cation selected from the group consisting of $Mg^{+2}$ and $Mn^{+2}$;

(4) a mixture of nucleotides comprising a triphosphate nucleotide capable of interacting with GTPase to form a cofactor necessary for the activation of phosphodiesterase and a cyclic-monophosphate nucleotide capable of being hydrolyzed to produce a proton; and (5) means for detecting protons.

32. The light-sensitive composition of claim 31 wherein said phospholipid membranes comprise a phospholipid represented by the formula:

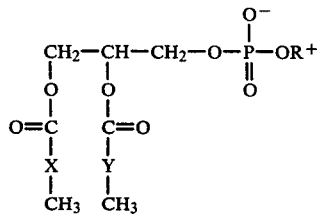

wherein X and Y are independently selected from the group consisting of saturated and unsaturated aliphatic groups, and $R^+$ is 2-trimethylammonioethyl, ammonioethyl or 2-carboxy-2-ammonioethyl.

33. The light-sensitive composition of claim 31 wherein the molar ratio of rhodopsin to phospholipid in said vesicles is from 1:25 to 1:25,000.

34. The light-sensitive composition of claim 31 wherein the vesicle size is from about 250 Å to about 10 microns.

35. The light-sensitive composition of claim 31 wherein the hydrophilic binder is gelatin.

36. The light-sensitive composition of claim 31 wherein said means for detecting protons is an indicator dye.

37. A process for preparing a light-sensitive composition, said composition comprising a hydrophilic binder containing:

(1) a plurality of vesicles comprising phospholipid membranes containing rhodopsin;

(2) a mixture of enzymes comprising phosphodiesterase and GTPase;

(3) at least one metal cation selected from the group consisting of $Mg^{+2}$ and $Mn^{+2}$;

(4) a mixture of nucleotides comprising a triphosphate nucleotide capable of interacting with GTPase to form a cofactor necessary for the activation of phosphodiesterase and a cyclic-monophosphate nucleotide capable of being hydrolyzed to form a protein; and (5) means for detecting proton;

said process comprising:

(a) forming a dispersion of vesicles comprising phospholipid membranes containing rhodopsin by:

(i) isolating rhodopsin from rod outer segment membranes obtained from dark-adapted vertebrate retinae;

(ii) combining said rhodopsin with a phospholipid and a detergent to form a solution; and (iii) removing said detergent from said solution to form a dispersion of vesicles;

(b) isolating said mixture of enzymes by washing rod outer segment membranes obtained from dark-adapted vertebrate retinae with a hypotonic buffer solution to form a solution of said mixture of enzymes; and (c) combining said solution of enzymes with said dispersion of vesicles of step (a), predetermined amounts of said metal cation, said mixture of nucleotides, the hydrophilic binder, and said means for detecting protons.

38. The process of claim 37 wherein said phospholipid membranes comprise a phospholipid represented by the formula:

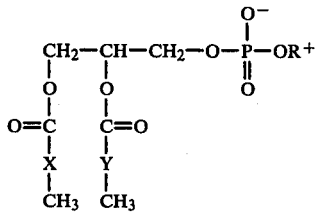

wherein X and Y are independently selected from the group consisting of saturated and unsaturated aliphatic groups, and $R^+$ is 2-trimethylammonioethyl, ammonioethyl or 2-carboxy-2-ammonioethyl.

39. The process of claim 37 wherein said isolated rhodopsin is purified before step (a)(ii).

40. The process of claim 37 wherein said rhodopsin and said phospholipid are combined in step (a)(ii) in a molar ratio of from 1:25 to 1:25,000.

41. The process of claim 37 wherein said detergent is removed in step (a)(iii) by dialysis.

42. The process of claim 37 wherein the vesicle size is from about 250 Å to about 10 microns.

43. The process of claim 37 wherein said dispersion of vesicles is concentrated to a 1 to 5 percent weight-/volume ratio between steps (a) and (c).

44. The process of claim 37 wherein said solution of enzymes is concentrated to the original protein content between steps (b) and (c).

45. The process of claim 37 wherein the hydrophilic binder is gelatin.

46. The process of claim 37 wherein said means for detecting protons is an indicator dye.

* * * * *